US008173558B2

(12) United States Patent
Fukuoka et al.

(10) Patent No.: US 8,173,558 B2
(45) Date of Patent: May 8, 2012

(54) WEFT KNITTED FABRIC INCLUDING POLYURETHANE ELASTOMER FIBER AND PROCESS FOR PRODUCING THE SAME

(75) Inventors: Kunihiro Fukuoka, Tokushima (JP); Koji Nishio, Tokushima (JP); Seiji Yamahara, Miyazu (JP); Takahiro Yamazaki, Maniwa (JP); Takashi Maruoka, Miyazu (JP); Fumiyuki Yamasaki, Maniwa (JP); Susumu Kibune, Miyazu (JP); Tsutomu Suzuoki, Asago (JP); Shigeo Souda, Miyazu (JP); Taisuke Yamamoto, Asago (JP); Kouji Kimura, Asago (JP); Shinobu Tabata, Asago (JP)

(73) Assignees: Nisshinbo Textile Inc., Tokyo (JP); Gunze, Limited, Ayabe-shi (JP)

( * ) Notice: Subject to any disclaimer, the term of this patent is extended or adjusted under 35 U.S.C. 154(b) by 446 days.

(21) Appl. No.: 11/628,759

(22) PCT Filed: Jun. 7, 2005

(86) PCT No.: PCT/JP2005/010411

§ 371 (c)(1),
(2), (4) Date: Dec. 7, 2006

(87) PCT Pub. No.: WO2005/121424

PCT Pub. Date: Dec. 22, 2005

(65) Prior Publication Data

US 2008/0032580 A1 Feb. 7, 2008

(30) Foreign Application Priority Data

Jun. 9, 2004 (JP) ..... 2004-171806

(51) Int. Cl.
*D04B 1/14* (2006.01)
*D04B 1/18* (2006.01)
*D04B 1/22* (2006.01)
*D04B 9/34* (2006.01)
*B29C 47/88* (2006.01)

(52) U.S. Cl. ..... 442/310; 442/306; 442/312; 66/136; 264/176.1; 264/211.12

(58) Field of Classification Search ..... 442/306, 442/310, 312; 264/176.1, 211.12; 525/59, 525/74; 66/136, 172 R, 172 E
See application file for complete search history.

(56) References Cited

U.S. PATENT DOCUMENTS 6,252,031 B1 6/2001 Tsutsumi et al.

(Continued)

FOREIGN PATENT DOCUMENTS

JP 2-8058 B2 2/1990

(Continued)

OTHER PUBLICATIONS

English Machine Translation of JP 2002-115119, Published Apr. 19, 2002.*

(Continued)

*Primary Examiner* — Jenna Johnson

(74) *Attorney, Agent, or Firm* — Westerman, Hattori, Daniels & Adrian, LLP

(57) ABSTRACT

A polyurethane elastomeric filament-containing weft knit fabric is obtained by plating a bare yarn of highly fusible, alkali-resistant polyurethane elastomeric filament having at least 50% retention of tenacity following dry heat treatment under 100% extension at 150° C. for 45 seconds, a melting point of 180° C. or below, and at least 60% retention of tenacity following treatment in a 2 g/L aqueous sodium hydroxide solution under 100% extension at 100° C. for 60 minutes at every loop of a weft knit fabric having a 1×1 rib knit structure or a center yarn-containing reversible knit structure composed of at least one type of non-elastomeric yarn, then heat setting the plated structure so as to thermally fuse the highly fusible, alkali-resistant polyurethane elastomeric filaments to each other or to the non-elastomeric yarns at crossover points therebetween.

14 Claims, 2 Drawing Sheets

U.S. PATENT DOCUMENTS

| | | | | |
|---|---|---|---|---|
| 6,776,014 | B1 * | 8/2004 | Laycock et al. | 66/198 |
| 2002/0161137 | A1 * | 10/2002 | Wilkinson | 525/453 |
| 2006/0030229 | A1 | 2/2006 | Fukuoka et al. | |

FOREIGN PATENT DOCUMENTS

| | | | |
|---|---|---|---|
| JP | 04-011036 | A | 1/1992 |
| JP | 9-273050 | A | 10/1997 |
| JP | 2001-159052 | A | 6/2001 |
| JP | 2001-164444 | A | 6/2001 |
| JP | 2001-355126 | A | 12/2001 |
| JP | 2002-013052 | A | 1/2002 |
| JP | 2002-069804 | A | 3/2002 |
| JP | 2002-115119 | A | 4/2002 |
| JP | 2004-076209 | A | 3/2004 |
| WO | WO 99/39030 | A1 | 8/1999 |
| WO | 2004053218 | | 6/2004 |

OTHER PUBLICATIONS

Humphries, Mary. Fabric Reference. Prentice Hall Upper Saddle River, NJ. 1996. pp. 123-125.*

International Search Report of PCT/JP2005/010411, date of mailing Sep. 13, 2005.

Notification of Transmittal of Translation of the International Preliminary Report on Patentability (Form PCT/IB/338) of International Application No. PCT/JP2005/010411 mailed Dec. 28, 2006 with Forms PCT/IB/373 and PCT/ISA/237.

Liu Shilong, "Study of Elasticity Control of Weft Knitted Fabrics", 1994-2009 China Academic Journal Electronic Publishing House, p. 50-51.

* cited by examiner (F1)

(F2)

(F3)

WEFT KNITTED FABRIC INCLUDING POLYURETHANE ELASTOMER FIBER AND PROCESS FOR PRODUCING THE SAME

TECHNICAL FIELD

The present invention relates to a polyurethane elastomeric filament-containing blended weft knit fabric which has an excellent alkali resistance and can be used "as cut" without treating cut edges of the fabric, and to a method of manufacturing such a fabric. More specifically, the invention relates to a polyurethane elastomeric filament-containing blended weft knit fabric which minimizes the occurrence of fabric defects such as deformation, yarn slippage and corrugation (the shifting, loss or loosening of elastomeric filaments) from repeated stretching when articles made from the knit fabric are worn, fraying in which threads are lost from cut edges of the fabric, damage or defects of the type known as laddering or running that arise in the fabric structure, curling of the fabric, and the effect sometimes referred to as "slip-in" where just the elastomeric filaments pull away from cut edges of the fabric, causing the fabric to lose its stretch in places. The invention relates most particularly to such weft knit fabrics which can be used as cut without treating cut edges of the fabric. The invention relates also to a process for manufacturing such weft knit fabrics.

BACKGROUND ART

Articles made from polyurethane elastomeric filament-containing blended weft knit fabrics are widely used on account of their high stretch, good recovery from extension, and good fit. However, when repeatedly stretched, a polyurethane elastomeric filament-containing blended weft knit fabric will deform and lose its uniformity, readily giving rise to problems such as the above-described deformation, yarn slippage, corrugation, fraying, running, curling and slip-in.

These problems are generally dealt with by folding back the edge of the knit fabric or by sewing another fabric or stretch tape to the fabric edge. However, because of concerns over dermatosis from direct contact by the wearer's skin with raised areas, steps and seams in the fabric, and also because of unresolved problems such as diminished feel and comfort when worn and loss of aesthetics due to visible effects on accompanying outerwear, a desire has existed for knit fabrics which can be used as cut without having to sew the cut edges of the fabric.

Various methods have been found for rendering knit fabrics directly into manufactured articles without sewing the fabric edges. In warp knit fabrics, innovations such as increasing the density of the fabric or modifying the fabric structure have led to knit fabrics which can be used "as cut." Weft knit fabrics are generally subject to fraying and have a low density. Yet, although methods do exist to prevent fraying by modifying the knit structure to what is referred to as an edging stitch, it has not been possible to render weft knit fabrics directly "as cut" into manufactured articles. Moreover, in methods for manufacturing articles that involve changing the knit structure, such an approach represents a major obstacle to increased productivity and lower costs. Hence, there is a very considerable desire for weft knit fabrics which are capable of being free cut and can be used directly as cut.

It has been proposed that fibers be thermally fused to each other to reduce deformation, yarn slippage, corrugation, fraying, running and curling. In attempts where the heat setting temperature has been raised so as to thermally fuse the typically high-melting polyurethane elastomeric filaments at crossover points therebetween, the need to carry out heat setting at a high temperature has led to undesirable changes in tactile qualities and a lower colorfastness, including specifically yellowing and a hardening in the hand of the fibers with which the polyurethane elastomeric filaments are used. Another problem has been an insufficient degree of thermal fusion and thus substantial separation at thermal fusion sites, resulting in a loss in the ladder-resisting and fray-preventing effects when the article is worn and during laundering. Moreover, lowering the heat-setting temperature leads to a complete loss of the thermal fusing effect.

If special polyurethane elastomeric filaments which fuse at a low temperature are used, these filaments can be fused at a low heat-setting temperature of 140 to 160° C. However, the other yarns with which they are knit do not set to a sufficient degree, giving rise to problems such as creasing of the greige fabric and uneven dyeing. On the other hand, if heat setting is carried out within a temperature range at which the other yarns used in knitting can set properly, the low temperature-fusing elastomeric filaments will experience a large decline in strength within the knit fabric, lowering the recovery of the fabric from extension and leading to yarn breakage within the heat-set fabric. Another problem that remains is that, even were it possible to strongly fuse the filaments at a low temperature, the fabric thus obtained, when used as a conventional single-knit weft knit fabric, for example, would harden as a result of heat setting.

By using a low-melting filaments other than polyurethane, fusion can be achieved at a setting temperature of 130 to 185° C. (see JP-B 2-8058 and JP 2001-164444 A). However, when fusion is effected using such low-melting filaments, the fusion and the hardening of the fibers combine to make the hand of the fabric even harder, thus detracting from the comfort of the article when worn and in extreme cases even causing dermatosis and greatly diminishing the stretch.

JP-A 2001-159052 discloses a method for preventing yarn slippage by heat treating at 200° C. a fabric knit from two types of polyether ester elastomeric filaments having different melting points. However, compared with polyurethane elastomeric filaments, polyether ester elastomeric filaments have a less than satisfactory performance in terms of stretch properties such as extensibility and recovery from extension, and thus leave much to be desired.

DISCLOSURE OF THE INVENTION

Problems to be Solved by the Invention

It is therefore an object of the invention to provide polyurethane elastomeric filament-containing blended weft knit fabrics which are able to retain the high extensibility and high recovery from extension inherent to polyurethane elastomeric filaments even when post-treatment such as alkali treatment is carried out, and which discourage problems such as fabric deformation, yarn slippage, corrugation, fraying, running, curling and slip-in, particularly polyurethane elastomeric filament-containing blended weft knit fabrics in which cut edges of the fabric can be used as is—that is, in an "as cut" state. Another object of the invention is to provide a method for manufacturing such fabrics.

Means for Solving the Problems

As a result of extensive investigations, we have discovered that polyurethane elastomeric filament-containing weft knit fabrics which are obtained by plating a bare yarn of highly fusible, alkali-resistant polyurethane elastomeric filament having at least 50% retention of tenacity following dry heat treatment under 100% extension at 150° C. for 45 seconds, a melting point of 180° C. or below, and at least 60% retention of tenacity following treatment in a 2 g/L aqueous sodium hydroxide solution under 100% extension at 100° C. for 60 minutes at every loop of a weft knit fabric having a 1×1 rib knit structure or a center yarn-containing reversible knit structure composed of at least one type of non-elastomeric yarn, then heat setting the plated fabric so as to thermally fuse the highly fusible, alkali-resistant polyurethane elastomeric filaments to each other or to the non-elastomeric yarns at crossover points therebetween, have an excellent extensibility and an excellent recovery from extension and do not undergo fabric deterioration even when subjected to post-treatment such as scouring under alkaline conditions, thus enabling the extensibility and recovery from extension inherent to the polyurethane elastomeric filaments to be retained. Moreover, because heat setting causes the filaments to fuse to each other, defects such as fabric deformation, running, curling, fraying and slip-in can be prevented, enabling the fabric to be used with the cut edges in an untreated, "as cut," state. As a result, the use of such a fabric in inner and outer wear enables knit apparel that is very comfortable and aesthetically pleasing to be obtained.

The present invention thus provides the following polyurethane elastomeric filament-containing blended weft knit fabrics and a process for manufacturing such fabrics. (1) A polyurethane elastomeric filament-containing weft knit fabric obtained by plating a bare yarn of highly fusible, alkali-resistant polyurethane elastomeric filament having at least 50% retention of tenacity following dry heat treatment under 100% extension at 150° C. for 45 seconds, a melting point of 180° C. or below, and at least 60% retention of tenacity following treatment in a 2 g/L aqueous sodium hydroxide solution under 100% extension at 100° C. for 60 minutes at every loop of a weft knit fabric having a 1×1 rib knit structure or a center yarn-containing reversible knit structure composed of at least one type of non-elastomeric yarn, then heat setting the plated structure so as to thermally fuse the highly fusible, alkali-resistant polyurethane elastomeric filaments to each other or to the non-elastomeric yarns at crossover points therebetween. (2) The weft knit fabric of (1) above, wherein the highly fusible, alkali-resistant elastomeric filament is melt spun from a polymer obtained by reacting (A) a diisocyanate-terminated prepolymer prepared by the reaction of a polyol and a diisocyanate, with (B) a dihydroxy-terminated prepolymer prepared by the reaction of a polyol, a diisocyanate and a low-molecular-weight diol, wherein at least 50 wt % of the total polyol is polyether polyol. (3) The weft knit fabric of (1) or (2) above which is adapted for use as inner or outer knitwear. (4) A process for manufacturing the weft knit fabric according to any one of (1) to (3) above, the method being characterized by plating a bare yarn of highly fusible, alkali-resistant polyurethane elastomeric filament having at least 50% retention of tenacity following dry heat treatment under 100% extension at 150° C. for 45 seconds, a melting point of 180° C. or below, and at least 60% retention of tenacity following treatment in a 2 g/L aqueous sodium hydroxide solution under 100% extension at 100° C. for 60 minutes as a plating yarn at every loop of a weft knit fabric having a 1×1 rib knit structure or a center yarn-containing reversible knit structure composed of at least one type of non-elastomeric yarn, then heat setting the plated structure so as to thermally fuse the highly fusible, alkali-resistant polyurethane elastomeric filaments to each other or to the non-elastomeric yarns at crossover points therebetween.

Effects of the Invention

In the production of a knit fabric, the knitting operation is generally followed by presetting, scouring, dyeing and final setting. Highly fusible, alkali-resistant polyurethane elastomeric filaments retain the extensibility and recovery from extension inherent to such filaments even when subjected to alkali treatment such as scouring. When a weft knit fabric with a 1×1 rib knit structure or a center yarn-containing reversible knit structure in which such polyurethane elastomeric filaments have been plated in every loop of the fabric is heat-set, some of the highly fusible, alkali-resistant polyurethane elastomeric filaments melt, resulting in thermal fusion of the polyurethane elastomeric filaments to each other or to the non-elastomeric yarns at crossover points therebetween. Such fusion fixes the structure of the fabric, giving a weft knit fabric which is resistant to deformation, yarn slippage, corrugation, fraying, running, curling and slip-in, and has excellent extensibility and recovery from extension.

BRIEF DESCRIPTION OF THE DIAGRAMS

BEST MODE FOR CARRYING OUT THE INVENTION

Figure 1:
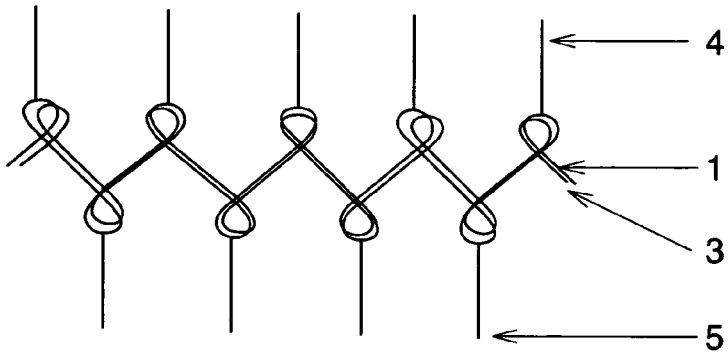
FIG. 1 is a diagram showing a 1×1 rib knit fabric structure.

The weft knit fabric of the invention is a polyurethane elastomeric filament-containing weft knit fabric obtained by plating a bare yarn of highly fusible, alkali-resistant polyurethane elastomeric filament having at least 50% retention of tenacity following dry heat treatment under 100% extension at 150° C. for 45 seconds, a melting point of 180° C. or below, and at least 60% retention of tenacity following treatment in a 2 g/L aqueous sodium hydroxide solution under 100% extension at 100° C. for 60 minutes at every loop of a weft knit fabric having a 1×1 rib knit structure or center yarn-containing reversible knit structure composed of at least one type of non-elastomeric yarn, then heat setting the plated structure so as to thermally fuse the highly fusible, alkali-resistant polyurethane elastomeric filaments to each other or to the non-elastomeric yarns at crossover points therebetween.

The highly fusible, alkali-resistant polyurethane elastomeric filaments used in the invention have at least 50% retention of tenacity, and preferably at least 55% retention of tenacity, following dry heat treatment under 100% extension at 150° C. for 45 seconds. At less than 50% retention of tenacity, the manufactured article will have a lower stretch after heat setting. The percent retention of tenacity, while not subject to any particular upper limit, is generally 90% or less, and especially 80% or less.

The highly fusible, alkali-resistant polyurethane elastomeric filaments have a melting point of 180° C. or below, and preferably 175° C. or below. At a melting point above 180° C., the heat treatment temperature for causing filaments to fuse to each other is too high, adversely affecting such qualities of the resulting textile product as its hand and colorfastness. A melting point of at least 150° C., and preferably at least 155° C., is advantageous in terms of the setting effects on the other yarns used in knitting, the ability of the fabric to take up dye, and the dimensional stability of the fabric. However, the melting point may be even lower if low-temperature heat treatment of the other yarns used in knitting is desirable.

The highly fusible, alkali-resistant polyurethane elastomeric filaments have at least 60% retention of tenacity, and preferably at least 65% retention of tenacity, following treatment in a 2 g/L aqueous sodium hydroxide solution under 100% extension at 100° C. for 60 minutes. At less than 60% retention of tenacity, the manufactured article will have a lower recovery from extension after alkali treatment, and yarn breakage may occur during knitting. The percent retention of tenacity, while not subject to any particular upper limit, is generally 150% or less, and especially 130% or less. Methods for measuring the retention of tenacity, retention of tenacity after alkali treatment, and melting point are described later in the specification.

For reasons having to do with the hand of the knit fabric, it is preferable for the highly fusible, alkali-resistant polyurethane elastomeric filaments used in the invention to have a size of 11 to 311 decitex (dtex), and especially 15 to 156 dtex. If the polyurethane elastomeric filaments are too slender, yarn breakage may break during heat treatment, lowering the recovery from extension and stretch power of the knit fabric. On the other hand, if these filaments are too thick, the knittability may decline and the knit fabric may have too much stretch power. The size of these filaments may be varied in accordance with the intended use of the resulting fabric.

The highly fusible, alkali-resistant polyurethane elastomeric filaments having the above-indicated retention of tenacity after heat treatment, retention of tenacity after alkali treatment, and melting point which are used in the invention are not subject to any particular limitation with regard to their makeup and method of manufacture, provided they are polyurethane elastomeric filaments which readily fuse even at low temperatures and are both heat resistant and alkali resistant. Suitable methods of producing such filaments include processes in which a polyol is reacted with an excess molar amount of diisocyanate to form a polyurethane intermediate polymer having isocyanate groups at both ends, the intermediate polymer is reacted in an inert organic solvent with a low-molecular-weight diamine or low-molecular-weight diol having active hydrogens capable of readily reacting with the isocyanate groups on the intermediate polymer so as to form a polymer solution, then the solvent is removed and the polymer is shaped into filaments; processes in which a polymer formed by reacting a polyol and a diisocyanate with a low-molecular-weight diol is solidified, then dissolved in a solvent, after which the solvent is removed and the polymer is shaped into filaments; processes in which the above solidified polymer is heated and shaped into filaments without being dissolved in a solvent; processes in which the above polyol, diisocyanate and low-molecular-weight diol are reacted to form a polymer, which is then shaped into filaments without first being solidified; processes in which a polymer obtained by reacting a polyol with a diisocyanate is reacted with a polymer obtained by reacting a polyol, a diisocyanate and a low-molecular-weight diol to form a new polymer, which is then shaped into filaments without being solidified; and processes in which polymers or polymer solutions obtained by the various above processes are mixed, following which the solvent is removed from the mixed polymer solution and the polymer is shaped into filaments.

Of the above, a process in which (A) a prepolymer obtained by reacting a polyol with a diisocyanate and having isocyanate groups (NCO groups) at both ends is reacted with (B) a prepolymer obtained by reacting a polyol with a diisocyanate and a low-molecular-weight diol and having hydroxyl groups (OH groups) at both ends is melt-spun without prior solidification is especially preferred because it gives highly fusible polyurethane elastomeric filaments which fuse easily at low temperatures and are heat resistant and alkali resistant. Moreover, such a process is cost-effective because it does not include the recovery of solvent.

The polyol used in prepolymers (A) and (B) may be the same or different. In both cases, the use of a polymeric diol having a number-average molecular weight in a range of about 500 to 4000, and especially about 800 to 3000, is preferred.

Such polymeric diols that are suitable for use include polyether glycols, polyester glycols and polycarbonate glycols.

Illustrative examples of polyether glycols include polyether diols obtained by the ring-opening polymerization of a cyclic ether such as ethylene oxide, propylene oxide or tetrahydrofuran; and polyether glycols obtained by the polycondensation of a glycol such as ethylene glycol, propylene glycol, 1,4-butanediol, 1,5-pentanediol, neopentyl glycol, 1,6-hexanediol and 3-methyl-1,5-pentanediol.

Illustrative examples of polyester glycols include polyester glycols obtained by the polycondensation of at least one glycol selected from among ethylene glycol, propylene glycol, 1,4-butanediol, 1,5-pentanediol, neopentyl glycol, 1,6-hexanediol and 3-methyl-1,5-pentanediol with at least one dibasic acid selected from among adipic acid, sebacic acid and azelaic acid; and polyester glycols obtained by the ring-opening polymerization of a lactone such as ϵ-caprolactone or valerolactone.

Illustrative examples of polycarbonate glycols include those obtained by the transesterification of at least one organic carbonate selected from among dialkyl carbonates such as dimethyl carbonate and diethyl carbonate, alkylene carbonates such as ethylene carbonate and propylene carbonate, and diaryl carbonates such as diphenyl carbonate and dinaphthyl carbonate, with at least one aliphatic diol selected from among ethylene glycol, propylene glycol, 1,4-butanediol, 1,5-pentanediol, neopentyl glycol, 1,6-hexanediol and 3-methyl-1,5-pentanediol.

The above polyether glycol, polyester glycol or polycarbonate glycol may be used singly or as combinations of two or more thereof. However, to obtain a good fusibility and good alkali resistance, it is desirable for the polyether diol component to account for at least 50 wt %, and preferably at least 60 wt %, of the total amount of polymeric diol used. The polyether diol component is not subject to any particular upper limit, and may even account for 100 wt % of the polymeric diol used. Polytetramethylene ether glycol (PTMG) is especially preferred as the polyether diol component.

The diisocyanate used in prepolymers (A) and (B) may be any type of diisocyanate commonly used in the production of polyurethanes, such as aliphatic, alicyclic, aromatic and aromatic-aliphatic diisocyanates.

Illustrative examples of such diisocyanates include 4,4'-diphenylmethane duisocyanate, 2,4-tolylene diisocyanate, 1,5-naphthalene diisocyanate, xylylene diisocyanate, isophorone duisocyanate, 1,6-hexane diisocyanate, p-phenylene diisocyanate and 4,4'-cyclohexyl diisocyanate. Any one or combination thereof may be used. Of these, 4,4'-diphenylmethane duisocyanate (MDI) is preferred.

The low-molecular weight diol which serves as a chain extender in component (B) is preferably one which has a suitable reaction rate and imparts an appropriate heat resistance. A low-molecular-weight compound having on the molecule two active hydrogen atoms capable of reacting with isocyanate groups and generally having a molecular weight of 500 or less-is used. Suitable examples of such low-molecular-weight diols include aliphatic diols such as ethylene glycol, propylene glycol, 1,4-butanediol, 1,5-pentanediol, neopentyl glycol, 1,6-hexanediol, and 3-methyl-1,5-pentanediol. Trifunctional glycols such as glycerol can also be used provided the spinnability is not compromised. Any one or combination of two or more of these compounds may be used, although 1,4-butanediol is preferred as the main component for obtaining good workability and for imparting suitable properties to the resulting filaments.

To the prepolymers serving as above components (A) and (B) may be added optional ingredients such as ultraviolet absorbers, antioxidants and light stabilizers to improve weather resistance, heat and oxidation resistance and yellowing resistance.

Illustrative examples of ultraviolet absorbers include benzotriazole compounds such as is 2-(3,5-di-t-amyl-2-hydroxyphenyl)benzotriazole, 2-(3-t-butyl-5-methyl-2-hydroxyphenyl)-5-chlorobenzotriazole and 2-(2-hydroxy-3,5-bisphenyl)benzotriazole.

Illustrative examples of antioxidants include hindered phenol antioxidants such as 3,9-bis(2-(3-(3-t-butyl-4-hydroxy-5-methylphenyl)propionyl-oxy)-1,1-dimethylethyl)-2,4,8,10-tetraoxaspiro[5.5]undecane, 1,3,5-tris(4-t-butyl-3-hydroxy-2,6-dimethylbenzyl)isocyanuric acid and pentaerythritol tetrakis[3-(3,5-di-t-butyl-4-hydroxyphenyl)propionate].

Illustrative examples of light stabilizers include hindered amine light stabilizers such as bis(2,2,6,6-tetramethyl-4-piperidyl)sebacate, bis(1,2,2,6,6-pentamethyl-4-piperidyl)sebacate, and the dimethyl-1-(2-hydroxyethyl)-4-hydroxy-2,2,6,6-tetramethylpiperidine condensation product of succinic acid.

The process by which the highly fusible, alkali-resistant polyurethane elastomeric filaments used in the invention are obtained is not subject to any particular limitation. Examples of known melt spinning techniques that may be used include the following.

(1) Melt spinning from chips of polyurethane elastomer.
(2) A process in which chips of polyurethane elastomer are melted, a polyisocyanate compound is mixed with the melt, and spinning is carried out.
(3) A reaction spinning process that involves synthesizing a spinning polymer by reacting a low-molecular-weight diol with a prepolymer prepared from a polyol and a diisocyanate, then spinning the polymer without prior solidification.

Of these, Process (3) is preferred because it does not include a polyurethane elastomer chip handling step and is thus simpler than Processes (1) and (2). This process is also desirable because, by adjusting the proportion of prepolymer added to the reactor, the amount of residual isocyanate groups left in the polyurethane elastomeric filaments after spinning can be controlled, making it possible to achieve an improved heat resistance from chain extending reactions by these residual isocyanate groups. Moreover, the low-molecular-weight diol can be reacted beforehand with some of the prepolymer to form a prepolymer having excess hydroxyl groups which is then added to the reactor.

It is advantageous to obtain the polyurethane elastomeric filaments used in the invention by, in accordance with Process (3), feeding prepolymers (A) and (B) continuously and at a constant rate to a reactor, and melt spinning the resulting polymer without prior solidification.

Synthesis of the spinning polymer in this way involves three reactions: (I) synthesis of a diisocyanate-terminated prepolymer, (II) synthesis of a dihydroxy-terminated prepolymer, and (III) synthesis of a spinning polymer by feeding these two prepolymers to a reactor and continuous reaction. The compositional ratio of the starting materials for the three above reactions as a whole, when expressed as the ratio of the number of moles of all the diisocyanate to the combined number of moles of all the polymeric diol and all the low-molecular-weight diol, is preferably from 1.02 to 1.20, and more preferably from 1.03 to 1.15.

More specifically, the above diisocyanate-terminated prepolymer (I) can be obtained by, for example, charging a given amount of diisocyanate into a tank equipped with a warm-water jacket and a stirrer, then adding a given amount of polymeric diol under stirring, and stirring at 50 to 90° C. for 0.5 to 2 hours under a nitrogen purge. The diisocyanate-terminated prepolymer obtained from this reaction is then fed by a jacketed gear pump (e.g., KAP-1, manufactured by Kawasaki Heavy Industries, Ltd.) to a reactor for polyurethane elastomeric filament production.

The above dihydroxy-terminated prepolymer (II) can be obtained by charging a given amount of diisocyanate into a tank equipped with a warm-water jacket and a stirrer, adding a given amount of polymeric diol under stirring, then stirring at 50 to 90° C. for 0.5 to 2 hours under a nitrogen purge to give a precursor, and subsequently adding a low-molecular-weight diol and reacting it with the precursor under stirring. The resulting dihydroxy-terminated prepolymer is then fed by a jacketed gear pump (e.g., KAP-1, manufactured by Kawasaki Heavy Industries, Ltd.) to the reactor for polyurethane elastomeric filament production.

During the synthesis of these two prepolymers (A) and (B), the various chemicals mentioned above may be added to improve such properties as the weather resistance, heat and oxidation resistance, and yellowing resistance.

The spinning polymer (III) can be synthesized by continuously reacting prepolymers (A) and (B) fed to the reactor in a fixed ratio. The feed ratio of prepolymers (A) and (B) varies with the molecular weights of the starting materials used and the proportions in which they are added. For example, when MDI is used as the diisocyanate in prepolymers (A) and (B), 1,4-butandiol is used as the chain extender, a polyol having a molecular weight of 2000 is added, and the molar ratio of MDI and the polyol in the prepolymer (B) is set at 2.0, the feed ratio by weight of prepolymer (A) to prepolymer (B) is preferably from 1:0.393 to 1:0.513, and more preferably from 1:0.406 to 1:0.507. When a polyol having a molecular weight of 1000 is used in prepolymer (B), the feed ratio, while not subject to any particular limitation, is preferably from 1:0.253 to 1:0.332, and more preferably from 1:0.263 to 1:0.329. The reactor may be one commonly used in polyurethane elastomeric filament melt spinning processes and is preferably equipped with mechanisms for heating the spinning polymer, stirring and reacting the molten mixture, and transferring the polymer to a spinning head. Reaction is typically carried out at 160 to 230° C., and preferably 180 to 200° C., for a period of for 1 to 90 minutes, and preferably 3 to 80 minutes.

The highly fusible, alkali-resistant polyurethane elastomeric filaments used in the invention can be obtained by transferring the synthesized spinning polymer, without allowing it to solidify, to a spinning head and spinning the polymer by discharging it from a nozzle. The average residence time of the spinning polymer within the reactor varies with the type of reactor, and is calculated as follows.

$$\text{Average residence time in reactor} = [(\text{reactor volume})/(\text{discharge rate of spinning polymer})] \times (\text{specific gravity of spinning polymer})$$

The average residence time within the spinning polymer reactor is generally about 0.5 to 2 hours when a cylindrical reactor is used, and 5 to 10 minutes when a twin-screw extruder is used. The polyurethane elastomeric filament can be obtained by continuous extrusion from the nozzle at a spinning temperature of preferably 180 to 230° C., and more preferably 190 to 215° C., followed by cooling, the application of a spin finish, and wind-up.

It is advantageous for the ratio between the diisocyanate-terminated prepolymer and the dihydroxy-terminated prepolymer to be set by suitably adjusting the speed ratio between the gear pumps used for injecting the feedstocks so that the amount of isocyanate groups remaining in the just-spun filaments is 0.3 to 1 wt %, and preferably 0.35 to 0.85 wt %. The presence of isocyanate groups in an excess of at least 0.3 wt % enables physical properties such as tenacity, elongation and heat resistance to be improved by chain extension reactions after spinning. The presence of less than 0.3 wt % of isocyanate groups may lower the retention of tenacity after heat treatment by the resulting polyurethane elastomeric filament, whereas the presence of more than 1 wt % may lower the viscosity of the spinning polymer and make spinning difficult to carry out.

The content of isocyanate groups in the spun filament is measured as follows.

About 1 gram of the spun filament is dissolved in a dibutylamine/dimethylformamide/toluene solution, following which excess dibutylamine is reacted with isocyanate groups in the sample. The remaining dibutylamine is then titrated with hydrochloric acid, based on which the content of isocyanate groups in the sample is determined.

The weft knit fabric of the invention has a construction in which the above-described polyurethane elastomeric filament is incorporated by plating at every loop making up the front and back faces of a weft knit fabric having a 1×1 rib knit structure or a center yarn-containing reversible knit structure composed of at least one type of non-elastomeric yarn.

No particular limitation is imposed on the non-elastomeric yarns that may be used in the weft knit fabric of the invention. For example, use can be made of any type of yarn, including filament yarns, staple yarns and blended staple yarns, composed of natural fibers such as cotton, linen, wool and silk, regenerated fibers such as rayon, cuprammonium rayon and polynosic, semi-synthetic fibers such as acetate, and synthetic fibers such as nylon, polyester and acrylic. The size of the non-elastomeric yarn varies with the intended application of the knit fabric. In the case of staple yarn, the cotton yarn number is preferably about 20 to 100, and more preferably about 30 to 80. In the case of filament yarn, the size of the yarn is preferably about 10 to 100 d, and more preferably about 20 to 80 d. The non-elastomeric yarn may be of a single type used alone or may be of two or more types used in admixture.

The blending proportions between the non-elastomeric yarn and the highly fusible, alkali-resistant polyurethane elastomeric filament are such that the polyurethane elastomeric filament accounts for preferably about 1 to 20 wt %, and more preferably about 2 to 15 wt %, of the overall knit fabric. Too few polyurethane elastomeric filaments may diminish the sense of stretch and fit, whereas too many may intensify the sense of stretch or give the fabric an elastic-like hand.

Figure 3:
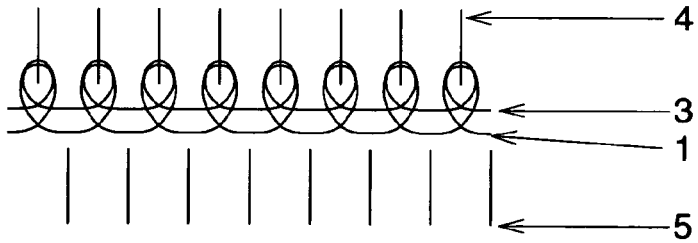
FIG. 3 is a diagram showing a center yarn-containing reversible knit fabric structure.
Figure 3:
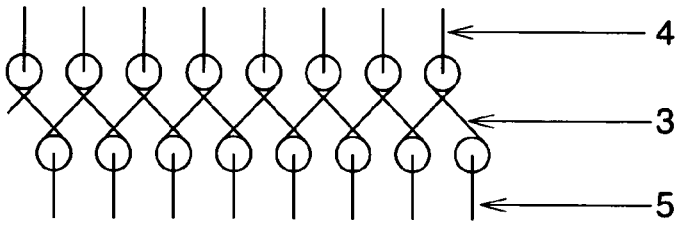
Figure 3:
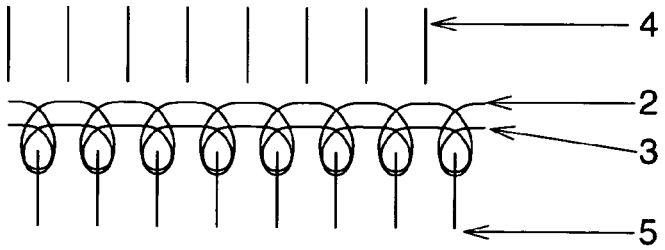
Figure 4:
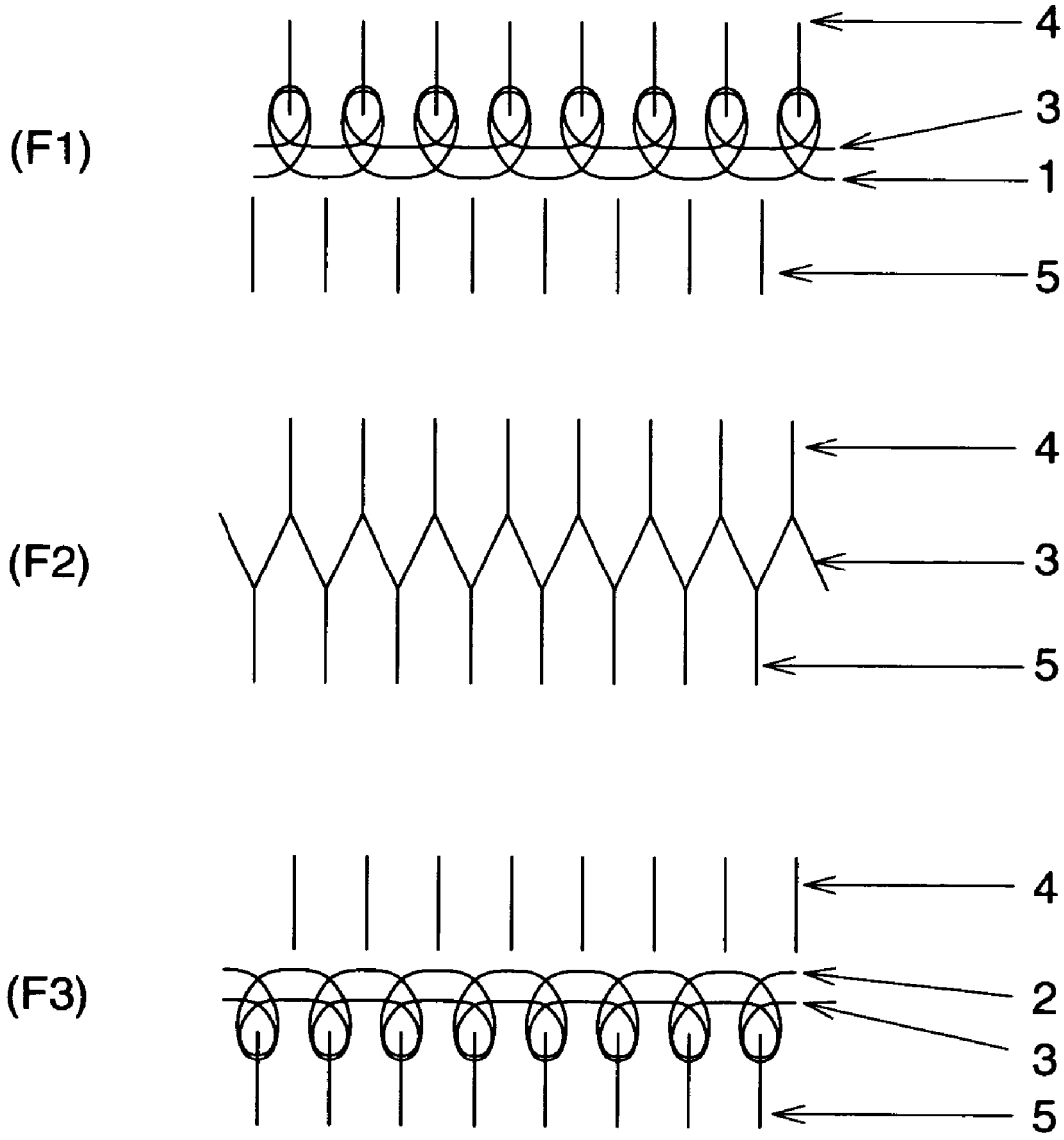
FIG. 4 is a diagram showing another center yarn-containing reversible knit fabric structure.

The weft knit fabric of the invention is illustrated more specifically by the knit fabric structures in FIGS. 1, 3 and 4. Shown in these diagrams are non-elastomeric yarns 1 and 2, a highly fusible, alkali-resistant polyurethane elastomeric filament 3, dial needles 4, cylinder needles 5, and yarn feeders F1 to F3. By incorporating the highly fusible, alkali-resistant polyurethane elastomeric filaments into a knit fabric composed of the non-elastomeric yarns and heat setting, the polyurethane elastomeric filaments fuse to each other or to the non-elastomeric yarns at crossover points therebetween, thus enabling a weft knit fabric to be obtained which is resistant to deformation, yarn slippage, corrugation, fraying, running, curling and slip-in.

The weft knit fabric of the invention can be obtained by plating the above highly fusible, alkali-resistant polyurethane elastomeric filament at every loop at both the front and back faces of a weft knit fabric having a 1×1 rib knit structure or a center yarn-containing reversible knit structure composed of at least one type of non-elastomeric yarn. For reasons having to do with the fabric design, the knit-in length of the non-elastomeric yarns is preferably 25 to 60 cm, and more preferably 44 to 54 cm, and the knit-in length of the highly fusible, alkali-resistant polyurethane elastomeric filaments is preferably 20 to 32 cm, and more preferably 24 to 27 cm. The "knit-in length" of a yarn refers herein to the value obtained by marking any wale on the knit fabric and marking the 100th wale from the first mark, then unraveling the fabric to free the yarn, applying an initial load of 0.005 kgf to the yarn, and measuring the length between the marks.

The knit fabric can be manufactured by a conventional method using an ordinary knitting machine such as may be used in the production of weft knit fabric. For example, if a circular knitting machine having upper and lower needle beds is used, the machine gauge is preferably 14 G to 22 G, the gap between the beds is preferably 60/100 to 80/100 mm, and the needle has a drawdown of preferably 0.6 to 1.5 mm. To reduce strain on the yarn being fed, delayed timing such that the knitting position of the dial needles lags 3.5 to 6.5 needles behind the knitting position of the cylinder needles is preferred. It is also desirable to use needles made specially for plating. Even when a flat knitting machine is used, the machine gauge is preferably 14 G to 22 G.

After the weft knit fabric has been knit in this way, it is heat set so as to induce the polyurethane elastomeric filaments in the fabric to fuse to each other or to the non-elastomeric yarns at crossover points therebetween. Dry heat setting or wet heat setting may be used. Dry heat setting can be carried out by opening up and inverting the knit fabric, and using a draft of hot air in a heat setting machine such as a pin tenter. Alternatively, the knit fabric, instead of being opened up and inverted, can be heat set without difficulty in a bag-like or tubular state. Dry heat setting is typically carried out at a temperature of 140 to 200° C., preferably 150 to 190° C., and for a period of 10 seconds to 3 minutes, preferably 20 seconds to 2 minutes.

Wet heat setting can be carried out by boarding the knit fabric in a form and carrying out heat setting with saturated steam at a predetermined pressure by a conventional method. This process is typically carried out at a temperature of 100 to 130° C., preferably 105 to 125° C., and for a period of typically 2 to 60 seconds, preferably 5 to 45 seconds.

The weft knit fabrics of the invention have a high extensibility and recovery from extension, and are able to retain an excellent extensibility and recovery from extension even when the fabric structure has been set by thermal fusion. Moreover, because it is possible to use as the face yarns not only synthetic fibers, but high-comfort staple yarns such as cotton and regenerated fibers, in addition to a high extensibility, the weft knit fabrics of the invention are also soft and have an excellent comfort and feel. By thermally fusing the filaments to each other or to the non-elastomeric yarns, cut edges of the fabric, even when left untreated, are not subject to problems such as fraying, making it possible to eliminate the need to treat cut edges. Moreover, inner wear in which the weft knit fabric of the invention is used as cut is more aesthetic in that it has little visible effect on outer wear worn over it. Accordingly, the instant weft knit fabric is highly suitable for use in various types of inner and outer knitwear. In particular, the instant fabric, when used as cut in at least part of an item of knitwear, can provide a broad variety of manufactured articles, include shorts, shirts, camisoles, slips, bodysuits, briefs, trunks, underwear, girdles, brassieres, spats, swimwear, gloves, sweaters, vests, training wear, leotards, skiwear, baseball clothes and other sportswear, pajamas and gowns.

EXAMPLES

Examples of the invention and Comparative Examples are given below by way of illustration, and not by way of limitation. In the examples, parts are given by weight.

Example 1

Production of Highly Fusible, Alkali-Resistant Polyurethane Elastomeric Filaments A reactor sealed with nitrogen and equipped with a 80° C. warm-water jacket was charged with 25 parts of 4,4'-diphenylmethane diisocyanate (MDI) as the diisocyanate, following which 100 parts of polytetramethylene ether glycol (PTMG) having a number-average molecular weight of 2,000 was added under stirring as the polymer diol. After one hour of reaction, 27.6 parts of 1,4-butanediol was added as the low-molecular-weight diol, thereby forming a dihydroxy-terminated prepolymer.

In a parallel operation, a nitrogen-sealed 80° C. reactor was charged with 47.4 parts of MDI as the diisocyanate and 2.2 parts of a mixture composed of an ultraviolet absorber (2-(3,5-di-t-amyl-2-hydroxyphenyl)-benzotriazole: 20%), an antioxidant (3,9-bis(2-(3-(3-t-butyl-4-hydroxy-5-methylphenyl) propionyloxy)-1,1-dimethyl-ethyl)-2,4,8,10-tetraoxaspiro [5.5]undecane: 50%) and a light stabilizer (bis(2,2,6,6-tetramethyl-4-piperidyl)sebacate: 30%). Next, 100 parts of PTMG having a number-average molecular weight of 2,000 was added under stirring, and stirring was continued for one hour, thereby giving a diisocyanate-terminated prepolymer.

The resulting diisocyanate-terminated prepolymer and dihydroxy-terminated prepolymer were continuously fed in a weight ratio of 1:0.475 to a 2,200 ml cylindrical reactor for polyurethane elastomeric filament production equipped with a stirring element. The feed rates were 28.93 g/min for the diisocyanate-terminated prepolymer and 13.74 g/min for the dihydroxy-terminated prepolymer. The average retention time within the reactor was about 1 hour, and the reaction temperature was about 190° C.

The resulting polymer was fed without solidification to two 8-nozzle spinning heads held at a temperature of 192° C. The spinning polymer was metered and pressurized by gear pumps mounted on the heads, passed through filters, and discharged from 0.6 mm diameter single-hole nozzles at a rate per nozzle of 2.67 g/min into a 6 m long spinning chimney (total discharge rate from all nozzles, 42.67 g/min), then wound up at a speed of 600 m/min while having a lubricant applied thereto, giving 44-decitex polyurethane elastomeric filaments. The filaments immediately after discharge had an isocyanate group content of 0.42 wt %.

The physical properties (melting point, retention of tenacity after heat treatment, and retention of tenacity after alkali treatment) of these polyurethane elastomeric filaments were measured by the methods described below. The filaments had a melting point of 166° C., 68% retention of tenacity after heat treatment, and 81% retention of tenacity after alkali treatment (size of undyed yarn, 44T; size of yarn after alkali treatment, 28T; tenacity of undyed yarn, 64.8 cN; tenacity of yarn after alkali treatment, 52.7 cN).

Melting Point Measurement

Measuring apparatus: Thermomechanical analyzer (TMA), with metal probe

Clamp interval: 20 mm

Extension: 0.5%

Temperature range: room temperature (25° C.) to 250° C.

Temperature rise rate: 20° C./min

Determination: The melting point was defined as the temperature at which the thermal stress became 0 mgf.

Measurement of Tenacity Retention after Heat Treatment

A polyurethane elastomeric filament was gripped at a clamp interval of 10 cm and extended to 20 cm. In this extended state, the filament was placed for 45 seconds in a hot air dryer held at 150° C. and heat treated. The tenacity of resulting heat-treated polyurethane elastomeric filament was then measured using a constant-rate-of-extension tensile testing machine at a clamp interval of 5 cm and a rate of extension of 500 mm/min. Measurement was carried out at an ambient temperature of 20° C. and 65% relative humidity. The retention of tenacity after heat treatment was obtained by calculating the tenacity of the filament after heat treatment as a percentage of the tenacity before heat treatment.

Measurement of Tenacity Retention after Alkali Treatment

A polyurethane elastomeric filament was extended to twice its length at rest, immersed in this state within an aqueous solution containing 2 g/L of sodium hydroxide held at 100° C., and treated for 60 minutes. The polyurethane elastomeric filament was then removed from the aqueous solution, gripped at a clamp interval of 5 cm in a tensile testing machine, extended at a constant speed of 500 mm/min, and its tenacity at break was measured. Measurement was carried out at an ambient temperature of 20° C. and 65% relative humidity. The retention of tenacity after alkali treatment was obtained by calculating the tenacity of the filament after alkali treatment as a percentage of the tenacity before alkali treatment.

[Manufacture of Knit Fabric]

Using these highly fusible, alkali-resistant polyurethane elastomeric filaments, a weft knit fabric was produced on a circular rib knitting machine (needle bed diameter, 17 inches; 18-gauge; 33 feeders) based on the fabric structure depicted in FIG. 1. Shown in FIG. 1 are a 100% cotton staple yarn 1 having a yarn count of 60, and a highly fusible, alkali-resistant polyurethane elastomeric filament 3. The knit-in lengths for the respective yarns were set at 51.2 cm for the cotton yarn 1 and 25.0 cm for the polyurethane elastomeric filament 3. A 1×1 rib knit fabric was produced by plating the cotton yarn 1 with the polyurethane elastomeric filament 3, and knit stitching the plated yarns on all of the dial needles 4 and all of the cylinder needles 5.

The resulting knit fabric was then dyed and treated under the following conditions.

1) A presetting step involving dry heat treatment at 185° C. for 50 seconds.
2) A scouring step involving 20 minutes of treatment at 90° C. using 2 mL/L of a scouring agent and 2.2 g/L of sodium hydroxide.
3) A bleaching step involving 30 minutes of treatment at 90° C. using 15 mL/L of 30% hydrogen peroxide, 5 mL/L of sodium silicate, and 1.1 g/L of sodium hydroxide.
4) A dyeing step involving 30 minutes of treatment at 90° C. using 30% owf of reactive dye, 90 g/L of anhydrous Glauber's salt, and 16 g/L of soda ash.

5) A fixing step involving 20 minutes of treatment at 50° C. using 3.0% owf of a fixing agent.

6) A soaping step involving 10 minutes of treatment at 90° C. using 1 mL/L of a soaping agent.

7) A final setting step involving 10 seconds of dry heat treatment at 150° C.

The following chemicals were used in the above steps.

Scouring agent: SSK-15A (produced by Matsumoto Yushi-Seiyaku Co., Ltd.)

Reactive dye: KPZOL BLACK KMN (produced by Kiwa Chemical industry Co., Ltd.)

Fixing agent: Danfix RE (produced by Nitto Boseki Co., Ltd.)

Soaping agent: Scourol TS840 (produced by Asahi Denka Kogyo KK)

Evaluation of the degree of thermal fusion in the dyed and treated fabric, measurement of the force at specified elongation, and evaluation of fraying of the knit fabric in laundering tests were carried out as described below. The results are presented in Table 1.

Degree of Thermal Fusion

The knit fabric was cut in the course direction, and the polyurethane elastomeric filaments at the cut edge were tested manually to determine whether they could be raveled out. Fabrics in which these filaments could not be raveled out were rated as having a good thermal fusion, and fabrics in which they could be raveled out were rated as having a poor thermal fusion.

Measurement of Load at Specified Elongation

A test specimen having a length of 2.5 cm and a width of 16 cm was collected from the knit fabric. The specimen was gripped at a clamp interval of 10 cm in a tensile testing machine, elongated 300% in the weft direction at a constant rate of extension of 300 mm/min, and the loads at 100% elongation and 200% elongation were measured. The ambient temperature during measurement was 20° C. and the relative humidity was 65%.

Laundering Method

A test specimen having a length of 5 cm and a width of 40 cm was collected from the knit fabric, sewn into a tubular shape, and washed under the following conditions using a two-drum washing machine for household use (manufactured by Toshiba Corporation under the trade name Ginga 4.5).

Washing (300 minutes)→Spinning (5 minutes)→Rinsing (10 minutes)→Spinning (5 minutes)

Water temperature: standard temperature (25° C.)

Water stream: strong stream

Detergent: Top (trade name), manufactured by Lion Corporation

Water volume: 30 liters

Detergent used per liter of water: 1.3 g

Loading fabric: 1.0 kg of bare, plain knit fabric made of cotton and polyurethane elastomeric filaments The degree of fraying at the edge of the knit fabric where it had been cut in the course direction was then examined and rated according to the following criteria.

| | |
|---|---|
| None: | No apparent damage |
| Minimal: | Slight damage observable |
| Substantial: | Significant damage |
| Severe: | Severe damage |

Comparative Example 1

Aside from using polyethylene adipate diol having a number average molecular weight of 2000 instead of PTMG and changing the mixing ratio of the diisocyanate-terminated prepolymer to the dihydroxy-terminated prepolymer to 1:0.440, 44 decitex polyester polyurethane elastomeric filaments were produced in the same way as in Example 1. The isocyanate group content just after discharge of the filaments was 0.80 wt %.

The physical properties of the polyurethane elastomeric filament thus obtained were measured in the same way as in Example 1. The filaments had a melting point of 171° C., 60% retention of tenacity after heat treatment, and 20% retention of tenacity after alkali treatment (size of undyed yarn, 44T; size of yarn after alkali treatment, 34T; tenacity of undyed yarn, 53.3 cN; tenacity of yarn after alkali treatment, 10.7 cN).

Using this polyurethane elastomeric filament, a knit fabric was manufactured and treated in the same way as in Example 1, then tested as described above. The results are shown in Table 1.

Comparative Example 2

Aside from using a 44-dtex polyurethane elastomeric filament (Mobilon P type yarn, manufactured by Nisshinbo Industries, Inc.) made with PTMG as the polyol and a diamine as the chain extender, a knit fabric was manufactured and treated in the same way as in Example 1, then tested as described above. The results are shown in Table 1.

This polyurethane elastomeric filament had a melting point of 231° C., a retention of tenacity after heat treatment of 112%, and a retention of tenacity after alkali treatment of 109% (size of undyed yarn, 44T; size of yarn after alkali treatment, 35T; tenacity of undyed yarn, 40.1 cN; tenacity of yarn after alkali treatment, 43.6 cN).

Comparative Example 3

Figure 2:
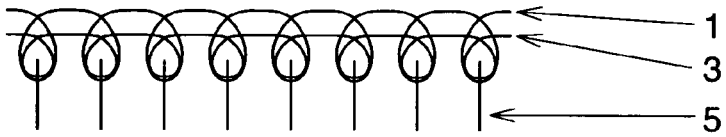
FIG. 2 is a diagram showing a plain knit fabric structure.

Using the same type of polyurethane elastomeric filament as in Example 1, a weft knit fabric was produced on a circular knitting machine (needle bed diameter, 38 inches; 28-gauge; 100 feeders) based on the fabric structure in FIG. 2. Shown in FIG. 2 are a 100% cotton staple yarn 1 having a yarn count of 60, a polyurethane elastomeric filament 3, and cylinder needles 5. The knit-in lengths for the respective yarns were set at 25.6 cm for the cotton yarn 1 and 14.3 cm for the polyurethane elastomeric filament 3. A bare plain knit fabric was produced by plating the cotton yarn 1 with the polyurethane elastomeric filaments 3, and knit stitching the plated yarns on all of the cylinder needles 5. The resulting knit fabric was then treated in the same way as in Example 1, and tested as described above. The results are shown in Table 1.

TABLE 1

| | Evaluation of treated fabric | | Load at specified elongation | | |
|---|---|---|---|---|---|
| | Polyurethane elastomeric filament yarn breakage | Degree of thermal fusion | At 100% elongation (cN) | At 200% elongation (cN) | Damage in laundering test |
| Example 1 | none | good thermal fusion (could not be unraveled) | 163 | 393 | none |
| Comparative Example 1 | breakage | good thermal fusion (could not be unraveled) | not measurable | not measurable | none |
| Comparative Example 2 | none | poor thermal fusion (could be easily unraveled) | 140 | 317 | severe |
| Comparative Example 3 | none | good thermal fusion (could not be unraveled) | 340 | 1113 | none |

The knit fabric in Example 1 had a structure that was fixed by thermal fusion. In the laundering test, no damage was observed at cut edges that were left untreated. Moreover, although the fabric structure was fixed by thermal fusion, the fabric exhibited low loads at specified elongations and the excellent extensibility inherent to polyurethane elastomeric filament-containing knit fabrics.

By contrast, in Comparative Example 1, scouring and bleaching treatment embrittled the polyurethane elastomeric filaments, leading to yarn breakage in the fully treated knit fabric and thus making the fabric unfit for practical use. In Comparative Example 2, thermal fusion substantially did not occur, as a result of which severe damage occurred at untreated cut edges of the fabric in the laundering test, making it impossible to use the knit fabric in an "as cut" state. In Comparative Example 3, strong thermal fusion resulted in the fixing of the fabric structure to such a degree as to give a knit fabric having a poor extensibility and a hard hand.

Example 2

Using highly fusible, alkali-resistant polyurethane elastomeric filaments of the same type as in Example 1, a knit fabric was produced on a circular rib knitting machine (needle bed diameter, 30 inches; 22-gauge; 60 feeders) based on the fabric structure depicted in FIG. 3. Shown in FIG. 3 are a 100% cotton staple yarn 1 having a yarn count of 80, a 78 dtex 24 filament false-twisted nylon yarn 2, the highly fusible, alkali-resistant polyurethane elastomeric filament 3, dial needles 4, cylinder needles 5, and yarn feeders F1 to F3. The knit-in lengths for the respective yarns were set at 30.0 cm each for the cotton yarn 1 and the nylon yarn 2, and 22.0 cm for the polyurethane elastomeric filament 3.

In this knit structure, the cotton yarn 1 and the polyurethane elastomeric filament 3 were fed by feeder F1 in a plating relationship and knit stitched on all of the dial needles 4; the polyurethane elastomeric filament 3 was fed by feeder F2 and knit stitched on all of the dial needles 4 and all of the cylinder needles 5; and the nylon yarn 2 and polyurethane elastomeric filament 3 were fed by feeder F3 in a plating relationship and knit stitched on all of the cylinder needles 5, thereby giving a center yarn-containing reversible knit fabric.

The resulting knit fabric was preset at a temperature of 185° C. for a period of 50 seconds, after which it was subjected to scouring, bleaching, dying and fixing in the same way as in Example 1, and final set at 150° C. for 10 seconds. The treated fabric was then subjected to the evaluation of thermal fusion and to a laundering test as in Example 1. The results are shown in Table 2.

Comparative Example 4

Aside from using the same polyurethane elastomeric filament as in Comparative Example 2 and presetting at 195° C. for 50 seconds, a knit fabric was produced and tested in the same way as in Example 2. The results are shown in Table 2.

Example 3

Referring to the knit fabric structure shown in FIG. 4, polyurethane elastomeric filament 3 was fed from feeder F2 and tuck stitched on all of the dial needles 4 and all of the cylinder needles 5, aside from which a center yarn-containing reversible knit structure was constructed in the same way as in Example 2, then treated and tested. The results are shown in Table 2.

Comparative Example 5

Aside from using the same polyurethane elastomeric filament as in Comparative Example 2 and presetting at 195° C. for 50 seconds, a knit fabric was produced and tested in the same way as in Example 3. The results are shown in Table 2.

TABLE 2

| | Evaluation of thermal fusing | Laundering test (evaluation of damage) |
|---|---|---|
| Example 2 | good thermal fusion (could not be unraveled) | none |
| Comparative Example 4 | poor thermal fusion (was easily unraveled) | severe |
| Example 3 | good thermal fusion (could not be unraveled) | minimal |
| Comparative Example 5 | poor thermal fusion (was easily unraveled) | severe |

The invention claimed is:

1. A polyurethane elastomeric filament-containing weft knit fabric obtained by providing a polymer obtained by reacting a diisocyanate-terminated prepolymer (A) and a dihydroxy-terminated prepolymer (B), the diisocyanate-terminated prepolymer (A) being obtained by reacting a first polymeric diol, having a number-average molecular weight of 800 to 4000, and a first diisocyanate, the dihydroxy-terminated prepolymer (B) being obtained by adding a second polymeric diol, having a number-average molecular weight of 800 to 4000, to a second diisocyanate to produce a diisocyanate-terminated precursor, and subsequently adding a low-molecular-weight diol having a molecular weight of 500 or less to the precursor, melt spinning the polymer without prior solidification to obtain a bare yarn of highly fusible, alkali-resistant polyurethane elastomeric filament having at least 50% retention of tenacity following dry heat treatment under 100% extension at 150° C. for 45 seconds, a melting point of 150 to 175° C., and at least 60% retention of tenacity following treatment in a 2 g/L aqueous sodium hydroxide solution under 100% extension at 100° C. for 60 minutes, separately feeding (i) the bare yarn and (ii) at least one type of non-elastomeric yarn, in order to form a weft knit fabric having a 1×1 rib knit structure by plating, such that the bare yarn is plated on the non-elastomeric yarn at every loop of the weft knit fabric, and then dry heat setting the plated structure at a temperature of 140 to 200° C. for 10 seconds to 3 minutes so as to thermally fuse the filaments of the bare yarn to each other or to the non-elastomeric yarns at crossover points therebetween, wherein 100 wt % of the total polymeric diol is polyether diol, and wherein the fabric has cut edges which are left in an as-cut state.

2. The weft knit fabric of claim 1 which is adapted for use as inner or outer knitwear.

3. The weft knit fabric of claim 2, wherein the inner knit wear is selected from the group consisting of shorts, shirts, camisoles, slips, bodysuits, briefs, trunks, underwear, girdles, and brassieres, and wherein the outer knitwear is selected from the group consisting of spats, swimwear, gloves, sweaters, vests, training wear, leotards, skiwear, baseball clothes, sportswear, pajamas and gowns.

4. The weft knit fabric of claim 1, wherein the molar ratio of the number of moles of all the diisocyanate to the combined number of moles of all the first and second polymeric diols and all the low-molecular-weight diol for the reactions as a whole is from 1.02 to 1.20, and the amount of isocyanate groups remaining in the just spun filaments is from 0.3 to 1 wt %.

5. The weft knit fabric of claim 1, wherein the first and second polymeric diols used in the prepolymers (A) and (B) are the same.

6. The weft knit fabric of claim 1, wherein the highly fusible, alkali-resistant polyurethane elastomeric filament has a size of 11 to 311 dtex, and the non-elastomeric yarn, in the case of staple yarn, has a cotton yarn number of from 20 to 100, and in the case of filament yarn, has a size of from 10 to 100 d.

7. The weft knit fabric of claim 1, wherein the highly fusible, alkali-resistant polyurethane elastomeric filament has a knit-in length of from 20 to 32 cm, and the non-elastomeric yarn has a knit-in length of from 25 to 60 cm.

8. The weft knit fabric of claim 1, wherein the non-elastomeric yarn is selected from the group consisting of cotton, linen, wool, silk, rayon, cuprammonium rayon, polynosic and acetate.

9. The weft knit fabric of claim 1, wherein the non-elastomeric yarn is selected from the group consisting of nylon, polyester and acrylic.

10. Inner knitwear made of the weft knit fabric of claim 1, which is selected from the group consisting of shorts, shirts, camisoles, slips, bodysuits, briefs, trunks and brassieres.

11. Outer knitwear made of the weft knit fabric of claim 1, which is selected from the group consisting of spats, gloves, sweaters, vests, training wear, leotards, pajamas and gowns.

12. A process for manufacturing a weft knit fabric, comprising:

providing a polymer obtained by reacting a diisocyanate-terminated prepolymer (A) and a dihydroxy-terminated prepolymer (B), the diisocyanate-terminated prepolymer (A) being obtained by reacting a first polymeric diol, having a number-average molecular weight of 800 to 4000, and a first diisocyanate, the dihydroxy-terminated prepolymer (B) being obtained by adding a second polymeric diol, having a number-average molecular weight of 800 to 4000, to a second diisocyanate to produce a diisocyanate-terminated precursor, and subsequently adding a low-molecular-weight diol having a molecular weight of 500 or less to the precursor, melt spinning the polymer without prior solidification to obtain a bare yarn of highly fusible, alkali-resistant polyurethane elastomeric filament having at least 50% retention of tenacity following dry heat treatment under 100% extension at 150° C. for 45 seconds, a melting point of 150 to 175° C., and at least 60% retention of tenacity following treatment in a 2 g/L aqueous sodium hydroxide solution under 100% extension at 100° C. for 60 minutes, separately feeding (i) the bare yarn and (ii) at least one type of non-elastomeric yarn, in order to form a weft knit fabric having a 1×1 rib knit structure by plating, such that the bare yarn is plated on the non-elastomeric yarn at every loop of the weft knit fabric, and then dry heat setting the plated structure at a temperature of 140 to 200° C. for 10 seconds to 3 minutes so as to thermally fuse the filaments of the bare yarn to each other or to the non-elastomeric yarns at crossover points therebetween, wherein 100 wt % of the total polymeric diol is polyether diol.

13. The method of claim 12, wherein the weft knit fabric is adapted for use as inner or outer knitwear.

14. The process of claim 12, further comprising cutting the fabric and leaving cut edges of the fabric in an as-cut state.

* * * * *